United States Patent [19]

Brice et al.

[11] 4,321,032

[45] Mar. 23, 1982

[54] PROCESS FOR THE TREATMENT OF COMBUSTIBLE GRANULAR AND/OR PULVERULENT MATERIAL BY DRYING AND/OR HEATING, AND AN INSTALLATION FOR CARRYING OUT THE PROCESS

[75] Inventors: Henri Brice, St-Avold; Roger M. Puff, Freyming-Merlebach; Jean-Claude Kita, Forbach,all of France

[73] Assignee: Charbonnages de France, Paris, France

[21] Appl. No.: 190,256

[22] Filed: Sep. 24, 1980

[30] Foreign Application Priority Data

Sep. 26, 1979 [FR] France ..... 79 23920
Jun. 10, 1980 [FR] France ..... 80 12876

[51] Int. Cl.[3] ..... F27B 15/00
[52] U.S. Cl. ..... 432/14; 432/58
[58] Field of Search ..... 432/14, 15, 58

[56] References Cited

U.S. PATENT DOCUMENTS 3,687,431 8/1972 Parks ..... 432/15
3,884,620 5/1975 Rammler ..... 432/15
4,008,042 2/1977 Auvil ..... 432/26
4,024,022 5/1977 Frühbuss ..... 201/23
4,030,983 6/1977 Beck ..... 201/23
4,174,947 11/1979 Delessard et al. ..... 432/15

FOREIGN PATENT DOCUMENTS 963435 7/1964 United Kingdom .
1232030 5/1971 United Kingdom .
1546294 5/1979 United Kingdom .

*Primary Examiner*—John J. Camby
*Attorney, Agent, or Firm*—Cushman, Darby & Cushman

[57] ABSTRACT

A process and an installation for the treatment of combustible granular or pulverulent material by drying and/or heating is disclosed. In one installation discharge gases are separated from dust in an electrostatic dust remover. Gases which have been partially recycled are divided between a direct recycling line and a path including the dust remover and a further duct so that the appropriate amount of gas is subject to dust removal to provide a desired throughput of gas. The dust captured by the dust remover is trapped in a hot liquid hydrocarbon and then used as a supplementary hydrocarbon binder.

13 Claims, 2 Drawing Figures

PROCESS FOR THE TREATMENT OF COMBUSTIBLE GRANULAR AND/OR PULVERULENT MATERIAL BY DRYING AND/OR HEATING, AND AN INSTALLATION FOR CARRYING OUT THE PROCESS

BACKGROUND OF THE INVENTION

The invention relates to a process and an installation for the treatment, by drying and/or heating by fluidisation and/or gas conveying, of a combustible granular and/or pulverulent material, such as a coal which is to be dried and/or pre-heated for charging low-coking into coke ovens by the so-called dry charging and preheated charging methods, or any other application in which a subsequent physical or chemical treatment is intended.

Processes and installations of the type which the invention proposes to improve are described, for example, in U.S. Pat. Nos. 3,884,620; 4,008,042; 4,174,947 and U.K. patent specification No. 1,546,294.

The preheating of coal fines requires the use of flue gas which is free from oxygen, at a temperature which must not exceed approximately 500° to 800° C. To achieve this result, it has been proposed to recycle a part of the flue gas which has been used for the preheating into the combustion chamber, where a neutral combustion is carried out.

To derive the greatest advantage from dry charging or preheated charging, the coal particles must be finely ground, with, for example, 80% and even 90% smaller than 2 mm. These fine particles of coal, preheated to 250° C., are separated from the conveying fluid by means of two cyclone stages, whose collecting efficiency is 98 to 99%.

The system of treatment of the flue gas, as presented, makes it possible to achieve the desired result but does not produce advantages only. In fact, the recycled flue gas wich has not been purified and is thus still charged with fine dust is introduced, by means of a fan, into the combustion chamber, in the vicinity of the burner which operates by stoichiometric combustion and hence at a temperature close to the theoretical temperature which, for coke oven gas, exceeds 2,000° C. The fine particles of coal may burn or melt, which is undesirable. In the known devices, the flue gas at the cyclone exit must be purified before release into the atmosphere.

In a first type, as described in U.S. Pat. No. 4,174,947, a dry dust removal is carried out only on the discharged flue gas, whilst in a second type, as described in U.S. Pat. No. 3,884,620, the whole of the flue gas, whether recycled or not, is subjected to a dry dust removal.

Furthermore, when the installation is idle (for example in the event of a breakdown upstream or downstream of the preheater), the amount of flue gas discharged into the atmosphere becomes very low so that, in the case of the first type of final dust remover, located on the line leading to the atmosphere, the working rate drops to a zero or very low throughput. If the dust remover is of the wet type, for example a high energy venturi, the reduction in the flue gas throughput is not troublesome. However, a wet dust remover is inappropriate because the recovered dust is advantageously introduced into the coke fines. With a dust remover of the dry type (sleeve-type filter and electrostatic filter) the reduction in the throughput of flue gas causes condensation and hence corrosion in the apparatus. Furthermore, there is the danger that the dust remover may run at sub-atmospheric pressure, thus causing stray entry of air into the installation.

However, if it is desired to instal a dry dust remover into an installation of the second type, it is necessary that the dust remover shoulder be of a size which can treat the maximum throughput of flue gas corresponding to normal running. Since it is not necessary to remove dust completely from the flue gas recycled to the combustion chamber although this is desirable, it is necessary to provide a very expensive installation suitable for the maximum throughput of flue gas. Furthermore, if the flue gas is purified dry, at least before being discharged into the atmosphere, the recovered dust should advantageously be reintroduced into the coal fines, that is to say into the coal which is undergoing, or has undergone, the prior treatment. However, this recovered dust consists of very reactive dry particles which may ignite spontaneously in contact with air, and which fly very easily. It is thus necessary to treat the dust so as to render it inert and capable of being handled. It is very difficult to wet with water. Furthermore, moistening it reduces the value of the dry dust removal process. It has already been proposed, in French Patent No. 1,265,397, or equivalent U.K. Patent 963,435 to improve the quality of the steelmaking coke obtained from a dried coal by adding to the coal, before or after it is dried, a hydrocarbon binder consisting of a coal tar, an artificial tar or a bitumen, or an extract or extraction residue, the said hydrocarbon binder being added in such a way that it assumes a pasty or liquid consistency. Another known advantage of the introduction of a hydrocarbon binder is to reduce the amount of flying dust at the time of charging the coal into the coke oven. It is for the same reason that it has also been proposed, in French Patent No. 2,306,252, or equivalent U.S. Pat. No. 4,030,983, to add the hydrocarbon binder in one of the conveyors for the already preheated coal and to do so just before the coal is charged into the coke oven, so as to reduce the flying dust during charging.

The main object of the invention is to avoid the disadvantages of the two abovementioned types of installations comprising a dry dust removal and to provide a process and an installation which possesses a dry dust remover which is neither overloaded nor oversized, and which is not subject to corrosion due to the danger of an insufficient throughput causing the temperature to drop below the dew point, especially during the idle periods when little heat is being produced in the installation. In other words, it is an aim of the invention to achieve the optimum dust removal efficiency of the dust remover.

Another object of the invention is to provide a solution to the problem of recovery and of handling and re-use of the recovered dust, by means of a particular treatment which will be presented.

SUMMARY OF THE INVENTION

According to the present invention there is provided a process for the treatment of a combustible granular or pulverulent material by drying and/or heating by conveying and/or fluidisation, in which the combustible material is dried and/or heated by conveying and/or fluidisation, the process comprising introducing the material into a conveying and/or fluidisation space, where a conveying and/or fluidisation operation at a given temperature is provided by means of a neutral gaseous agent obtained at a regulated temperature and in regulated amounts, in a combustion chamber, removing dried and/or heated combustible material from the space by pneumatic transport in the outflowing gaseous agent, separating the combustible material from the outflowing gaseous agent by dividing the gaseous agent, in regulated amounts, between a recycling line leading to the combustion chamber and a removal outlet for excess, and freeing the excess gaseous agent from dust by a dry dust remover, characterised in that a regulated part of the recycled gaseous agent is also subjected to dry dust removal, at least when introduction of the combustible granular or pulverulent material is interrupted, and in that the amount of recycled gaseous agent which has been subjected to dust removal is regulated by controlling the throughput of gas, which has been subjected to dust removal, to a target value.

In this way, the dry dust remover operates under all circumstances at a constant gas throughput and at a suitable temperature, which furthermore has already been regulated by regulating the burner of the combustion chamber. For each type of dust there is an optimum efficiency achieved by the corresponding speed of passage of gas.

The second object is achieved by a process in which a supplementary hydrocarbon binder is injected in the liquid state into the solid combustible material at one of the treatment stages, by trapping the dust, held back by the dry dust remover, in a hot carbonaceous liquid and using the hot carbonaceous liquid, charged with the dust, at least partially as the supplementary hydrocarbon binder.

The hot carbonaceous liquid, charged with the dust, may be injected into the combustible material after the exit point of the stage of separation from the heat-transfer gas which has acted as the gaseous outflowing transport agent.

It is advantageous if the carbonaceous liquid is very mobile and has a very high wetting action on the dust. For this purpose, it is advantageously chosen from the group consisting of the hydrocarbons which are more or less liquid at ambient temperature or after reheating, such as heavy fuel oil, or petroleum bitumens. In this way, a pumpable mixture is obtained, which can be incorporated into the preheated coal, as indicated above.

Also according to the present invention there is provided an installation for drying and/or heating a combustible granular or pulverulent material by conveying and/or fluidisation, for carrying out the process according to the process defined above, which installation possesses: a drying and/or heating device comprising:

a space for drying and/or heating by conveying and/or fluidisation, into the bottom of which opens a feed line for a gaseous conveying and/or fluidisation agent, means for introducing the material to be dried and/or heated into the space, and a conveying line for the dried and/or heated material, means for separating the granular or pulverulent material from the gaseous fluidisation agent, a combustion chamber for the production of the gaseous conveying and/or fluidisation agent leading to the feed line for the space, the combustion chamber possessing at least one burner operable over a given power range. means for regulating liquid or gaseous combustible material fed to the burner, pilot-controlled by means for measuring the temperature in the space, means for recycling a part of the gaseous conveying and/or fluidisation agent into the combustion chamber, in an amount regulable by at least one valve for distribution between a recyling line and a flue gas discharge line, and a dust remover for the discharged flue gas which, for better final separation of the particles from the conveying and/or fluidisation agent, comprises an electrostatic filter, which installation furthermore possesses:

a first means for distributing the gaseous conveying and/or fluidisation agent between a direct recycling circuit and a conjoint circuit for recycling and discharge via the electrostatic filter, a means for regulating the amount of gaseous conveying and/or fluidisation agent, passing through the electrostatic filter, at a target value, and a pressure regulator which operates by releasing a part of the gaseous agent, which has been subjected to dust removal, into the atmosphere.

It is advantageous if the means of regulating the amount of gaseous agent passing through the filter acts directly on the first means for distributing the gaseous agent.

The installation may comprise means for introducing liquid hydrocarbon binder into the solid combustible material at one of the treatment stages, and a device for trapping, in a carbonaceous liquid, the dust held back by the dust remover.

It is advantageous if the means for introducing the liquid hydrocarbon binder into the solid combustible material, such as coal, open downstream of the point at which the said combustible material issues from the coal/gas separating device; preferably, they open into a conveying/mixing screw, such as is known per se.

It is also advantageous if the installation possesses, in addition to this means of introduction of the liquid hydrocarbon binder into the combustible material, a contiguous conventional means for directly introducing hydrocarbon binder and/or carbonaceous liquid.

BRIEF DESCRIPTION OF THE DRAWINGS

An embodiment of the present invention will now be described by way of example and with reference to the accompanying drawings in which.

DESCRIPTION OF A PREFERRED EMBODIMENT

Figure 1:
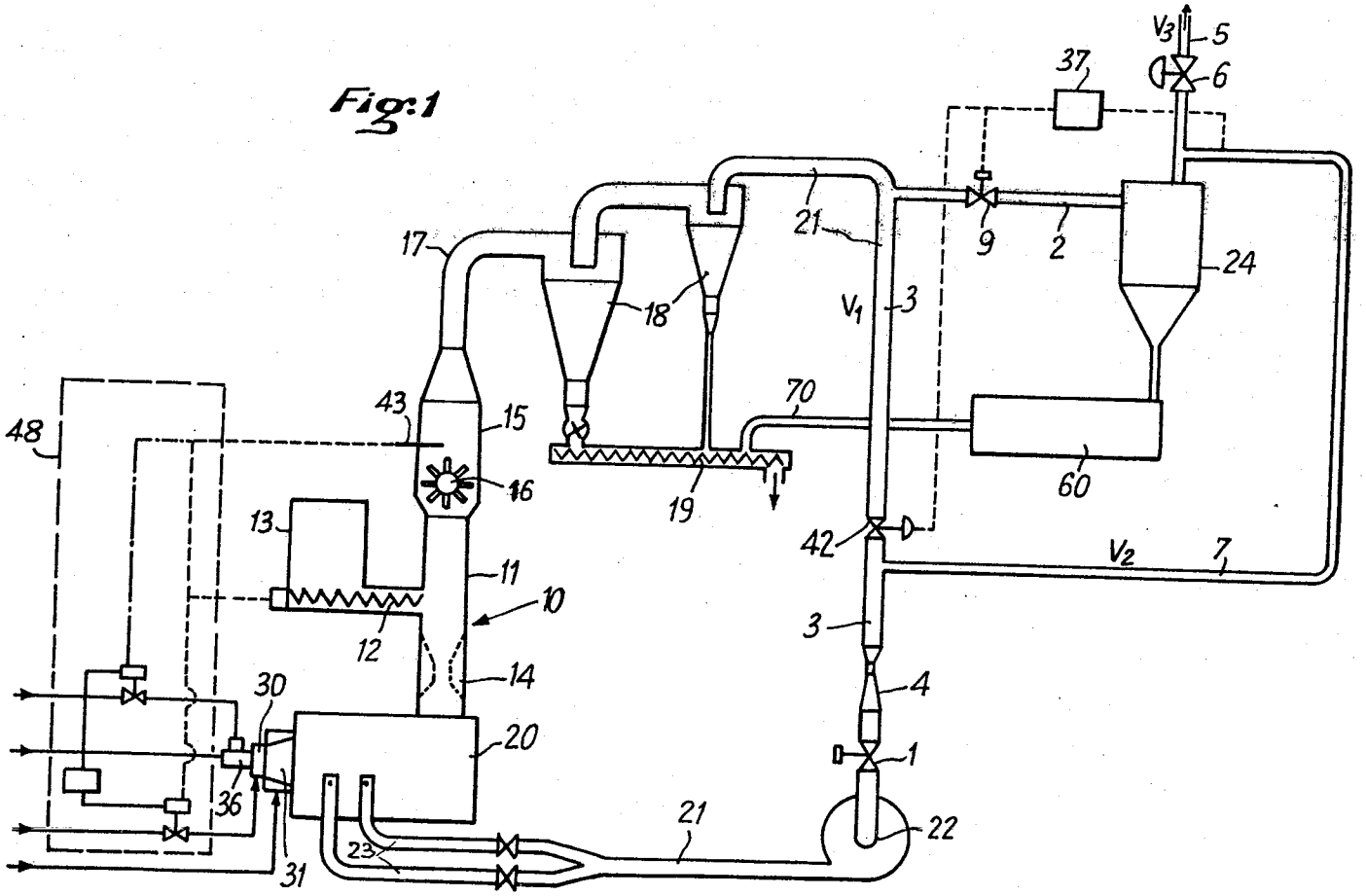
FIG. 1 is a simplified diagram of an installation according to the invention.

A coal preheating installation comprises a preheater dryer/grinder 10 comprising a vertical line 11 for the upward conveying of the coal by the hot flue gas. A screw conveyor 12 feeds the coal from a hopper 13 to the line 11 at a point located above a venturi 14 provided in the lower part of the line 11.

Above the line 11 is located a fluidisation chamber or space 15 into the lower part of which opens the duct 11, below a rotary percussive grinder 16.

From the top of the space 15 extends a line 17 for the conveying of the coal which has been preheated and ground in the space 15. The line 17 makes it possible to convey this coal to a battery of cyclones 18 possessing two stages, namely a primary cyclone and secondary cyclones, at the bottom end of which this coal is collected on a screw conveyor 19 leading to a storage hopper, from where it is subsequently charged into a coke oven. At the top of the cyclones 18, the flue gas is collected in a line 21 for recycling the flue gas by means of a fan 22.

The installation comprises a combustion chamber 20 which opens into the bottom of the ascending line 11. This combustion chamber is fed by a double burner 30 which in all respects is similar to that which is described in U.S. Pat. No. 4,174,947, that is to say it comprises a main burner 31 which in normal operation preheats the coal, and a supplementary burner 36 for putting the installation into idling in the event of an interruption of the feed of coal by the conveyor 12. Each burner is provided with means of regulating the combustion air so that the combustion is substantially neutral, and is furthermore provided with means of regulating the combustible material, pilot-controlled by temperature measurements in the fluidisation space. The fan 22 recycles, via gas pipes 23, a part of the flue gas taken from 21, the amount of this part being regulated so that the speed of the total gas flow is kept constant in the fluidisation space 15. A regulating unit 48 makes it possible to regulate the combustion at the double burner 30 as a function of the temperature measured at 43 in the space 15.

Up to this point, the essential features of what is known from the prior art processes and devices have been described; the attached control and regulating devices shown in the left-hand half of the figure and not referred to below are also known per se, for example from published French Patent Application No. 2,378,081, and there is no longer any need to describe them afresh.

A dry electrostatic dust remover 24 is fed through a line 2, branched off the recycling line 21, being separate from the part 3 of the line 21. On the outflowing gas side, the dust remover 24 feeds a discharge line 5, and another recycling line 7 which rejoins the line 3 upstream of the recycling fan 22. A valve 9 in the line 2, a valve 6 in the discharge line 5, and a valve 42 in the line 3 in the part which short-circuits the filter 24, make it possible to distribute the normal gas throughput V of the line 21, as desired, between a direct recycling throughput $V_1$ in the line 3, a recycling throughput $V_2$, with dust removal, via the line 7 which rejoins the line 3, and a throughput $V_3$ of discharge outflowing gas.

The pressure drop in the cyclones 18, which is a function of the gas throughput V, is kept constant, in a manner known per se, by the action of a valve 1. The throughput $V_3$ of outflowing gas to be discharged is regulated by the valve 6, which acts as a pressure regulator to keep the pressure in the electrostatic filter 24 at a constant value. A greater or lesser part of the throughput recycled into the combustion chamber 20 and measured at 4 is branched off to be definitively discharged at 5. For this purpose, the pressure drop observed between the inlet and outlet of the dust remover is measured, and the measurement is fed to a regulator 37 which controls the valve 42 and/or the valve 9 so as to ensure that the pressure drop between the inlet and outlet of the dust remover conforms to a target value.

In everything which has hitherto been said and in everything which follows, it will be noted that it is necesary to distinguish clearly between the separation stage and the dust removal stage. The separation stage, which consists of the cyclones 18, has as its object the separation of the dried and/or heated granular and/or pulverulent coal from the conveying gas, only minimal loss of one or the other being acceptable. The dust removal stage has as its object to return to the atmosphere, or to recycle, a gas which is as free as possible from dust, for example of about <0.05 mm, which has been conveyed into the vortex of the cyclones.

As an example, a preheating installation having a treatment capacity of 72 tonnes/hr will be considered. The total throughput of flue gas, V, namely 66,000 $Nm^3$/hr, which circulates in the preheater is kept constant by adjusting the throughput of the flue gases V1 and V2 recycled to the combustion chamber by means of the fan 22. The excess throughput V3 is discharged into the atmosphere.

The following applies: $V = V1 + V2 + V3 = \text{constant}$, and $V2 + V3 = \text{constant}$.

When the intallation operates at its nominal rate, the volume V3 is 24,000 $nm^3$/hr of flue gas. This is, by definition, the nominal throughput of the electrostatic filter. The throughput V2 must be zero and the throughput of recycled flue gas will therefore be $V1 = 42{,}000$ $Nm^3$/hr.

When the installation is operating at a power below nominal power, the throughput V3 must decrease, for example, to half-power; the throughput V3 will then be 12,000 $Nm^3$/hr, the throughput V2 will be 12,000 $Nm^3$/hr and the throughput of flue gas recycled into the combustion chamber will be $V1 + V2 = 54{,}000$ $Nm^3$/hr.

When the installation is idling, because of interruption of the supply of coal, the throughput of flue gas V3 must be very low (for example about 600 $Nm^3$/hr). It corresponds to the calorific throughput of the pilot burner. The throughput of flue gas recycled into the combustion chamber is then $V2 + V1$, with V2 being 24,000 $Nm^3$/hr and V1 being 41,400 $Nm^3$/hr.

By virtue of the invention, the disadvantages mentioned above, relating to the efficiency of the electrostatic filter and to the condensation of the flue gas, causing corrosion of the installation, are thus eliminated.

Figure 2:
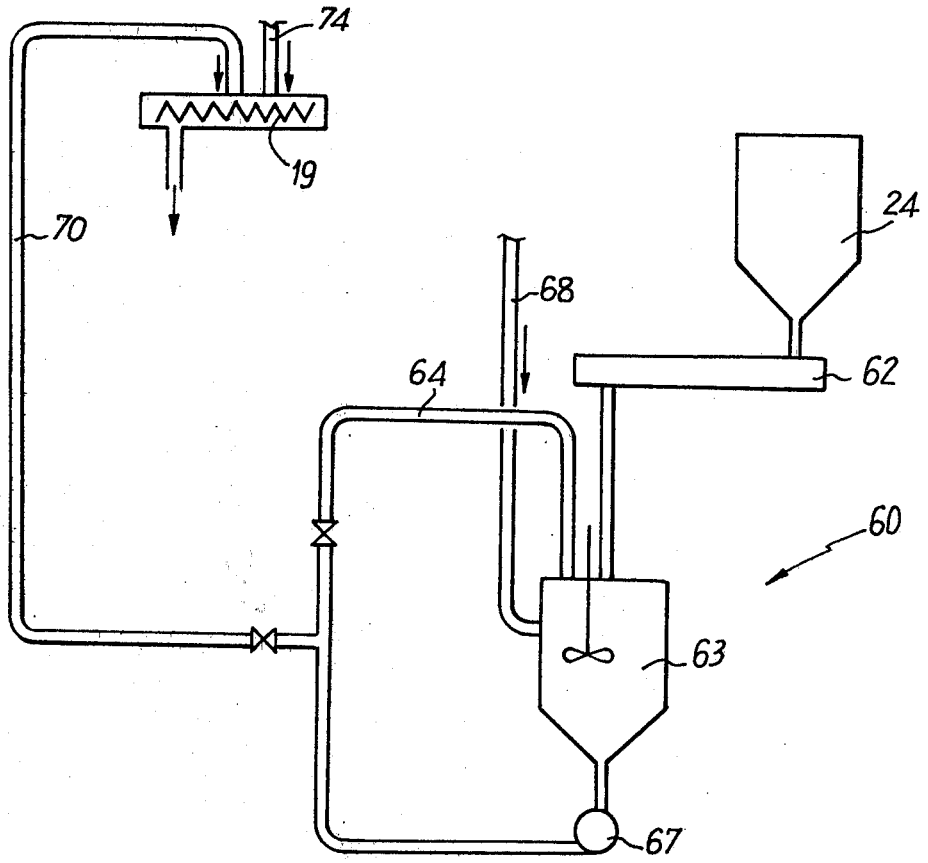
FIG. 2 is a detailed diagram of the device for trapping the dust held back by the dust remover.

The dust retained in the dry dust remover is passed into the screw conveyor 19 via a trapping device employing a carbonaceous liquid, which trapping device is simply indicated by the rectangle 60 in FIG. 1, but is shown schematically in its entirety in FIG. 2.

At the pointed bottom end at which the dry dust remover 24 discharges is provided an Archimedes screw 62 which feeds a malaxating and homogenishing device 63 of adequate capacity, which is also fed with a liquid hot hydrocarbon product through a line 64. The mixture is caused to circulate in a closed system via the line 64 by means of a pump 67. The topping up with pure liquid takes place via a line 68 leading into the device 63. A fraction of the mixture, corresponding to the amount of soot produced together with a sufficient amount of liquid for the handling of the material and for the requirements of the process, is taken from the closed circulation circuit and fed to the use point via a line 70.

In the example described, the use point is the abovementioned screw conveyor 19. It is advantageous to provide an additional point for introducing some of the carbonaceous liquid into the mixing screw 19 at 74.

The assembly of pipelines is heated by means of steam. The pipelines can be swept with steam to purge them, and it is advantageous to control the proportion of liquid/soot mixture as a function of the throughput of preheated coal, as is known per se for the addition of supplementary hydrocarbon binder to a preheated coal.

It will be seen that the invention makes it possible to recover, without moistening with water, the soot obtained from a dry dust remover, to handle the soot without danger and without causing pollution, and to convey it to a use point at a height which is compatible with the delivery pressure of the pump.

In the case of preheated charging (of the coke oven) with material in the form of fines, the invention furthermore makes it possible to recycle the soot from the dry dust remover to the preheated coking blend together with the fuel oil. But the invention equally permits the restriction of the amount of fly dust during charging, and to produce this effect instead by using the fuel oil/soot mixture.

By way of example, for an installation which allows the preheating of 72 tonnes/hr of coal, an electrostatic filter produced 100 to 200 kg/hr of soot. In total, about 0.8% by weight of heavy fuel oil No. 2, heated to 150° C. (the percentage being based on the total amount of preheated coal) is added.

A portion of the fuel oil, at the rate of about 400 kg/hr, is steam-sprayed into the mixer. The remainder, namely about 150 kg/hr, is sprayed pure onto the preheated coal in the mixing screw.

In the case of preheated charging (of the oven) with coal fines which have been compacted either by forming nuggets or by compressing, it is possible to recycle the soot to the preheated coking blend together with a petroleum bitumen which, moreover, when used by itself would make it possible to impart to the preheated coking blend the required cohesion to form either nuggets or a compressed cake from dry and hot coal, and by such recycling to prepare either nuggets or a compressed cake after having introduced, into the mixing screw, the total requisite amount of binder, of which all or part has been employed to handle the soot.

By way of example, for the abovementioned installation, which allows the preheating of 72 tonnes/hr of coal, equivalent to about 65 tonnes/hr of dry coal, 100 to 200 kg/hr of soot is produced at the electrostatic filter. A total of, for example, 6% by weight of a petroleum bitumen heated to 150° C. (the percentage being relative to the total amount of preheated coal) is added to the system. A portion of the bitumen, for example 650 kg/hr (or less) is steam-sprayed into the mixer. The remainder, namely 3,250 kg/hr, is added to the preheated coal on the mixing screw. A coal/binder mixture is thus obtained which is suitable either for producing nuggets or for compression, and contains the recycled soot from the dry dust remover.

The invention has been described in relation to an installation for drying and/or preheating by fluidisation. It is equally applicable to an installation for drying and/or preheating by co-current conveying in hot flue gas.

Ultimately, the advantages of the process and of the installation according to the invention are the following: it is possible to benefit, under all circumstances, from the efficiency of the dust removers of the dry electrostatic type, whose energy consumption is very low.

The efficiency of the electrostatic filter is an optimum, regardless of the running conditions of the preheating installation.

The weight of preheated coal for charging which is produced is increased.

The operation of the installation under idle conditions becomes more flexible and more reliable and can be regulated automatically.

Dust can easily be re-incorporated into the treated coal even though the dust is in a dry state and is difficult to wet.

We claim:

1. In a process for treating a particulate combustible material in which the combustible material is dried and heated by conveying fluidization, said process including the steps of:

(1) introducing the material into a fluidization space and heating the material so introduced to a pedetermined temperature with a neutral gaseous agent which is supplied at a predetermined temperature and in predetermined amounts from a combustion chamber;

(2) removing the heated combustible material from the fluidization space by pneumatic transport while entrained and fluidized in the outflowing gaseous agent;

(3) separating the combustible material from the outflowing gaseous agent by dividing the gaseous agent, in predetermined amounts, between (a) a recycling line leading to the combustion chamber, and (b) an outlet for removing excess of the gaseous agent; and (4) freeing the excess gaseous agent from dust with a dry dust remover;

the improvement including:

A. subjecting a predetermined amount of the recycled gaseous agent removed in step (3) (a) to dry dust removal, at least when the introduction of the particulate combustible material in step (1) is interrupted; and B. regulating the amount of recycled gaseous agent which has been subjected to dust removal by controlling the throughput of gas, which has been subjected to dust removal, within predetermined values.

2. The process according to claim 1, wherein a supplementary hydrocarbon binder is injected in the liquid state into the solid combustible material at one of the treatment stages thereby trapping dust removed by the dry dust remover and forming a hot carbonaceous liquid.

3. The process according to claim 2, wherein the hot carbonaceous liquid charged with the dust is injected into the solid combustible material downstream of step (2).

4. The process according to claim 2, wherein the hydrocarbon binder is liquid at ambient temperature or after reheating.

5. The process according to claim 2 or 4 wherein the hydrocarbon binder is heavy fuel oil or petroleum bitumen.

6. Apparatus for heating a particulate combustible material in a fluidization space with a hot gas, comprising:

a space for heating the particulate material by conveying and fluidization, the space having a bottom open and communicated with a feed line supplying gaseous conveying or fluidization agent;

means for introducing the particulate material to be heated into the space;

means for conveying the heated material from the space;

means for separating the heated particulate material from the gaseous fluidization agent;

combustion chamber means for producing and delivering the gaseous fluidization agent supplied to the heating space, the combustion chamber having at least one burner operable over a predetermined power range;

means for regulating a combustible liquid or gaseous material fed to the burner in accordance with a temperature measuring means positioned in the space;

recycle means communicated with the separating means and combustion chamber for recycling a portion of the gaseous fluidization agent from the separating means back into the combustion chamber;

at least one valve means communicating with the recycle means for distributing the gaeous fluidization agent between a recycling line and a flue gas discharge line;

electrostatic filter means for removing dust from the discharged flue gas and for separating the particles from the fluidization agent;

first means for distributing the gaseous fluidization agent between the recycle means circuit and a conjoint circuit for recycling and discharge via the electrostatic filter means;

means communicated with the electrostatic filter means for regulating the amount of gaseous fluidization agent, passing through the electrostatic filter to within predetermined values; and pressure regulator means communicated with the recycle means for releasing a portion of the thus treated substantially dust free gaseous agent into the atmosphere.

7. Appartus according to claim 6, wherein the means or regulating the amount of gaseous agent passing through the electrostatic filter is in operative communication with the first means for distribution of the gaseous agent.

8. Apparatus according to claim 6 further including means for introducing liquid hydrocarbon binder into the particulate combustible material in communication with the downstream end of the electrostatic filter, the liquid hydrocarbon binder trapping, in a carbonaceous liquid, the dust removed by the electrostatic filter means.

9. Apparatus according to claim 8 further including means for collecting the mixture of carbonaceous liquid and dust and means for injecting this mixture into the heated particulate material after separation from the gaseous fluidization agent.

10. Apparatus according to claim 9 wherein the means for introducing the liquid hydrocarbon binder is positioned upstream of the point of exit of the particulate material from the particulate material separating gaseous fluidization agent means.

11. Apparatus according to claim 10 further including a mixing/conveying screw and means at the downstream end of the particulate material/gas separating device for introducing the hydrocarbon binder into the mixing screw.

12. Appartus according to claim 8 further including a recirculating pump and a conduit for recirculating the contents of the means in which the liquid hydrocarbon binder is contacted with the particulate combustible material.

13. Apparatus according to claim 6, further including a second contiguous means for directly introducing the mixture of carbonaceous liquid and dust into the heated particulate material.

* * * * *